US006801139B2

(12) United States Patent
Tretyak, Jr.

(10) Patent No.: US 6,801,139 B2
(45) Date of Patent: Oct. 5, 2004

(54) METHOD AND SYSTEM FOR DELIVERING A TIME-EFFICIENT MOBILE VEHICLE ROUTE THAT ENCOMPASSES MULTIPLE LIMITED-DURATION EVENTS

(75) Inventor: Laurence J. Tretyak, Jr., Highland, MI (US)

(73) Assignee: General Motors Corporation, Detroit, MI (US)

( * ) Notice: Subject to any disclaimer, the term of this patent is extended or adjusted under 35 U.S.C. 154(b) by 335 days.

(21) Appl. No.: 10/137,751

(22) Filed: May 2, 2002

(65) Prior Publication Data

US 2003/0206121 A1 Nov. 6, 2003

(51) Int. Cl.[7] ..... G08G 1/123

(52) U.S. Cl. ..... 340/995.23; 340/995.1; 340/995.12

(58) Field of Search ..... 340/932.2, 995.23, 340/995.1, 995.12, 995.24; 701/200, 208, 209

(56) References Cited

U.S. PATENT DOCUMENTS 5,187,810 A * 2/1993 Yoneyama et al. ..... 455/509
6,374,177 B1 * 4/2002 Lee et al. ..... 701/200
6,622,087 B2 * 9/2003 Anderson ..... 701/209
6,650,284 B1 * 11/2003 Mannings et al. ..... 342/357.09

* cited by examiner

*Primary Examiner*—Toan Pham
(74) *Attorney, Agent, or Firm*—Anthony Luke Simon

(57) ABSTRACT

The invention provides a method for delivering a time-efficient mobile vehicle route that encompasses multiple limited-duration events. A plurality of limited-duration events is selected from an events database. The events database is incorporated into a communication services database associated with a call center. Events are selected through the call center or through a Web site. A driving route is generated. The route is delivered to the subscriber within a vehicle by a synthesized voice interface.

20 Claims, 4 Drawing Sheets

METHOD AND SYSTEM FOR DELIVERING A TIME-EFFICIENT MOBILE VEHICLE ROUTE THAT ENCOMPASSES MULTIPLE LIMITED-DURATION EVENTS

FIELD OF THE INVENTION

This invention relates generally to data transmission over a wireless communication system. More specifically, the invention relates to a method and system for delivering a time-efficient mobile vehicle route that encompasses multiple limited-duration events.

BACKGROUND OF THE INVENTION

Many methods and systems exist that provide mobile vehicle routes from one known location to another known location. Driving directions may be obtained through various Web sites. Routes may also be obtained via wireless communication services for mobile vehicles.

On a Web site, typically both the starting address and the address of the desired destination must be provided. When using wireless communication services, the starting address for a vehicle may be provided by a global positioning system, but the subscriber must still provide the address of the desired destination.

When the desired destination is a store or a movie theater or any relatively permanent place of business, a variety of databases are available to determine the address of the desired destination. These include telephone directories, business directories, and point-of-interest Web sites. When the desired destination is a limited-duration event, sources of information may be more limited and are likely to be event specific. For example, Web sites exist that provide locations of upcoming sporting events, and separate sites exist that list homes for sale. However, an individual who wants to spend a Saturday attending sporting events and looking for a new home would have difficulty finding information on both from a single on-line source.

If the individual is in a mobile vehicle and has forgotten to bring a newspaper or other source of event information into the vehicle, or if attending an event was unplanned when the individual entered the vehicle, routing information may be unattainable without an address for the desired event. Even if the individual has obtained adequate event information, a great deal of time may be required to determine a driving route that most efficiently encompasses all of the desired events.

A method is needed that offers access to a database of limited-duration events and allows an individual to quickly and easily obtain driving directions for reaching selected multiple events. Such a method would offer convenience and time savings not only to private individuals, for example families wanting to make the best use of their leisure time, but also to businesses, for example realtors seeking to show homes to clients in the most time-efficient manner. Therefore, it would be desirable to provide a method and system for delivering a time-efficient mobile vehicle route that encompasses multiple limited-duration events that overcomes the aforementioned and other disadvantages.

SUMMARY OF THE INVENTION

One aspect of the invention provides a method for delivering a time-efficient mobile vehicle route that encompasses multiple limited-duration events. A plurality of limited-duration events may be selected from an events database and a driving route generated based on the selected events. The route is then delivered to a subscriber.

Another aspect of the invention provides a computer-usable medium including a program for delivering a time-efficient mobile vehicle route that encompasses multiple limited-duration events. The program includes computer program code for selecting a plurality of limited-duration events from an events database, generating a driving route based on the selected limited-duration events, and delivering the route to a subscriber.

Yet another aspect of the invention provides a system for delivering a time-efficient mobile vehicle route that encompasses multiple limited-duration events. The system includes means for selecting a plurality of limited-duration events from an events database, for generating a driving route based on the selected limited-duration events, and for delivering the route to a subscriber.

The aforementioned, and other features and advantages of the invention, will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
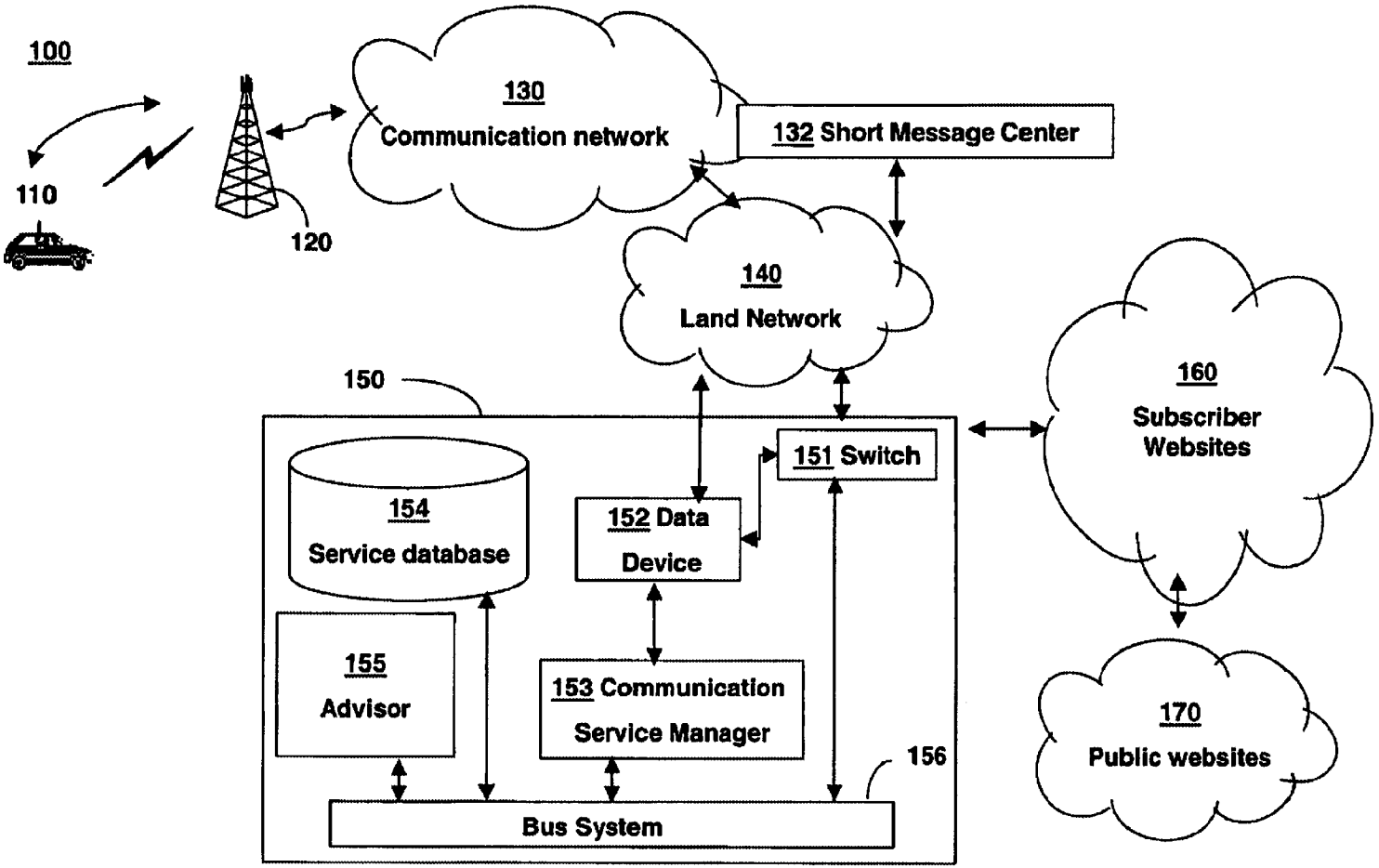
FIG. 1 is an illustration of one embodiment of a system for delivering a time-efficient mobile vehicle route that encompasses multiple limited-duration events, in accordance with the current invention.

FIG. 1 shows an illustration of one embodiment of a system for delivering a time-efficient mobile vehicle route that encompasses multiple limited-duration events using a wireless communication system, in accordance with the present invention at 100.

Mobile vehicle route delivery system 100 may contain one or more mobile vehicles 110, one or more wireless carrier systems 120, one or more communication networks 130, one or more short message service centers 132, one or more land networks 140, one or more call centers 150, one or more subscriber Web sites 160, and one or more public Web sites 170. Call center 150 may contain one or more switches 151, one or more data transmission devices 152, one or more communication services managers 153, one or more communication services databases 154, one or more advisors 155, and one or more bus systems 156.

Mobile vehicle 110 may contain a wireless vehicle communication device, such as an analog or digital phone with suitable hardware and software for transmitting and receiving data communications. Mobile vehicle 110 may contain a wireless modem for transmitting and receiving data. The data may represent information regarding limited-duration events or a mobile vehicle route for attending limited-duration events selected by a subscriber.

Mobile vehicle 110 may contain a global positioning system (GPS) unit capable of determining synchronized time and a geophysical location of the mobile vehicle. The GPS unit may be the source of positional information for the vehicle that is used, for example, to identify events occurring within a limited geographic area relative to the mobile vehicle.

Mobile vehicle 110 may contain a digital signal processor with software and additional hardware to enable communications with the mobile vehicle and to perform other routines and requested services. For example, a routine may be delivering a time-efficient mobile vehicle route to a subscriber.

Mobile vehicle 110 may send radio transmissions to and receive radio transmissions from wireless carrier system 120. Wireless carrier system 120 may be a wireless communications carrier. Wireless carrier system 120 may be, for example, a mobile telephone system. The mobile telephone system may be an analog mobile telephone system operating over a prescribed band nominally at 800 MHz. The mobile telephone system may be a digital mobile telephone system operating over a prescribed band nominally at 800 MHz, 900 MHz, 1900 MHz, or any suitable band capable of carrying mobile communications. Wireless carrier system 120 may transmit to and receive signals from mobile vehicle 110. Wireless carrier system 120 may transmit to and receive signals from a second mobile vehicle 110. Wireless carrier system 120 may be operably connected with communications network 130.

Communications network 130 may comprise a mobile switching center. Communications network 130 may comprise services from one or more wireless communications companies. Communications network 130 may be any suitable system or collection of systems for connecting wireless carrier system 120 to a second mobile vehicle 110 or to a call center.

Communications network 130 may include one or more short message service centers 132. Short message service center 132 may prescribe alphanumeric short messages to and from mobile vehicles 110. Short message service center 132 may include message entry features, administrative controls, and message transmission capabilities. Short message service center 132 may store and buffer the messages. Short message services may include functional services such as paging, text messaging and message waiting notification. Short message services may include other telematic services such as broadcast services, time-driven message delivery, autonomous message delivery, and database-driven information services. The telematic services may further include message management features, such as message priority levels, service categories, expiration dates, cancellations, and status checks.

Land network 140 may be a public-switched telephone network. Land network 140 may comprise a wired network, an optical network, a fiber network, another wireless network, or any combination thereof. Land network 140 may comprise an Internet protocol (IP) network. Land network 140 may connect communications network 130 to a call center.

Land network 140 may connect a first wireless carrier system 120 with a second wireless carrier system 120. Communication network 130 and land network 140 may connect wireless carrier system 120 to a communication node or call center 150. The communication delivered to the call center may be, for example, a selection of limited-duration events a subscriber wishes to attend.

Call center 150 may be a location where many calls may be received and serviced at the same time, or where many calls may be sent at the same time. The call center may be a telematics call center, prescribing communications to and from mobile vehicles 110. The call center may be a voice call center, providing verbal communications between an advisor in the call center and a subscriber in a mobile vehicle. The call center may contain each of these functions.

The call center 150 may contain switch 151. Switch 151 may be connected to land network 140 and may receive a modem signal from an analog modem or from a digital modem. Switch 151 may transmit voice or data transmission from a communication node. Switch 151 may also receive voice or data transmissions from mobile vehicle 110 through wireless carrier system 120, communications network 130, and land network 140. Switch 151 may receive from or send data transmissions to data transmission device 152. Switch 151 may receive from or send voice transmissions to advisor 155 via bus system 156.

Data transmission device 152 may send or receive data from switch 151. Data transmission device 152 may be an IP router or a modem. Data transmission device 152 may transfer data to or from advisor 155, one or more communication services managers 153, one or more communication services databases 154, and any other device connected to bus system 156. Data transmission device 152 may convey information received from communication network 130 to communication services manager 153.

Communication services manager 153 may be connected to switch 151, data transmission device 152, and advisor 155 through bus system 156. The call center may contain any combination of hardware or software facilitating data transmissions between call center 150 and mobile vehicle 110 and between call center 150 and Web site 160.

Communication services manager 153 may receive information from mobile vehicle 110 through wireless carrier system 120, communication network 130, land network 140, and data transmission device 152. Communication services manager 153 may send information to mobile vehicle 110 through data transmission device 152, land network 140, communication network 130, and wireless carrier system 120. Communication services manager 153 may provide information to mobile vehicle 110 from communication services database 154.

Communication services database 154 may contain records on one or more mobile vehicles 110. Records in communication services database 154 may include vehicle identification, location information, status information, and recent action information regarding mobile vehicle 110. Communication services database 154 may also contain information regarding limited-duration events. Communication services database 154 may provide information and other support to communication services manager 153.

Advisor 155 may be a real advisor or a virtual advisor. A real advisor may be a human being in verbal communication with the mobile communication device of vehicle 110. A virtual advisor may be a synthesized voice interface responding to requests from the mobile communication device of vehicle 110. Advisor 155 may provide services to the mobile communication device of vehicle 110. Advisor 155 may communicate with communication services manager 153 or any other device connected to bus system 156. Advisor 155 may provide information regarding limited-duration events or may deliver a mobile vehicle route to mobile vehicle 110 for attending events selected by a subscriber.

Call center 150 may receive information from subscriber Web site 160. The information received from subscriber Web site 160 may be a database of limited-duration events. The database of limited-duration events may be compiled by public Web site 170 and communicated to subscriber Web site 160. Call center 150 may incorporate the database of limited-duration events into communication services database 154. The information received by call center 150 from subscriber Web site 160 may also be a list of events selected by a subscriber on subscriber Web site 160.

Call center 150 may be capable of generating and delivering a driving route based on limited-duration events selected by a subscriber. A subscriber may select events and receive a driving route through advisor 155. In addition, a subscriber may select events through subscriber Web site 160. The selected events may be communicated from Web site 160 to call center 150, and the route may be delivered through advisor 155. Subscriber Web site 160 may also be capable of generating a driving route and delivering the route by printing from the Web site.

Figure 2:
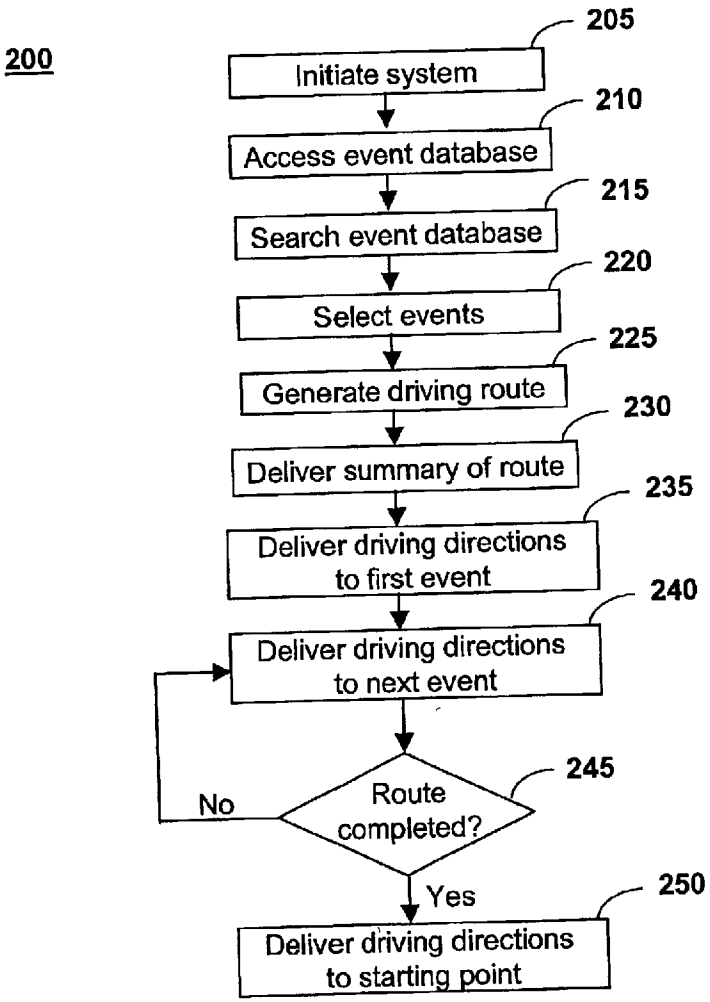
FIG. 2 is a flow diagram of one embodiment of a method for delivering a time-efficient mobile vehicle route that encompasses multiple limited-duration events in an example system according to FIG. 1.

FIG. 2 shows a flow diagram of one embodiment of a method for delivering a time-efficient mobile vehicle route that encompasses multiple limited-duration events, in accordance with the current invention at 200. Mobile vehicle route delivery method 200 comprises steps to access a database of limited-duration events, select desired events from the database, and receive a driving route that enables a subscriber to attend the selected events at appropriate times while driving the shortest distance.

A subscriber may initiate the system shown in FIG. 1. This may be accomplished by the driver pressing a button inside vehicle 110. The button may activate the vehicle's onboard digital signal processor, which may respond through a synthesized voice interface with an audible signal, for example "Ready" (Block 205).

The subscriber may access a database of limited-duration events that is incorporated into a communication services database 154 associated with a call center 150 (Block 210). To access the database, the driver may issue a voice command, for example "virtual advisor" to contact a virtual advisor 155.

The subscriber may then issue voice commands to search the event database using, for example, key words such as "community events," "garage sales," "festivals," or "home listings." The subscriber may also search the event database using times or locations (Block 215).

The subscriber may issue voice commands to select events of interest, for example garage sales (Block 220). The events available for selection may be located within a limited geographic area relative to the vehicle. The size of the limited geographic area may be predetermined by the call center or it may be specified by the subscriber on a Web site 160 prior to entering the vehicle.

Call center 150 may generate a driving route based on an algorithm that takes into consideration the times and locations of the events and thereby enables the subscriber to attend the selected events at appropriate times while driving the shortest distance (Block 225). The driving route may start from the current location of the vehicle as determined by a global positioning system within the vehicle.

A route summary may be delivered by the synthesized voice interface (Block 230). An example of a route summary may be as follows: "Your first stop is [the address or name of the first event]. Your second stop is [the address or name of the second event]. Your third stop is [the address or name of the third event]." Each event address or name may be listed in sequence until all of the events are identified.

Once the events have been summarized, the subscriber may receive detailed driving directions to the first event (Block 235). After attending that event and returning to the vehicle, the subscriber may receive detailed driving directions to the next event by issuing a voice command such as "resume route" (Block 240). After all of the events have been completed (Block 245), the subscriber may, if desired, receive driving directions back to the vehicle starting point (Block 250).

Figure 3:
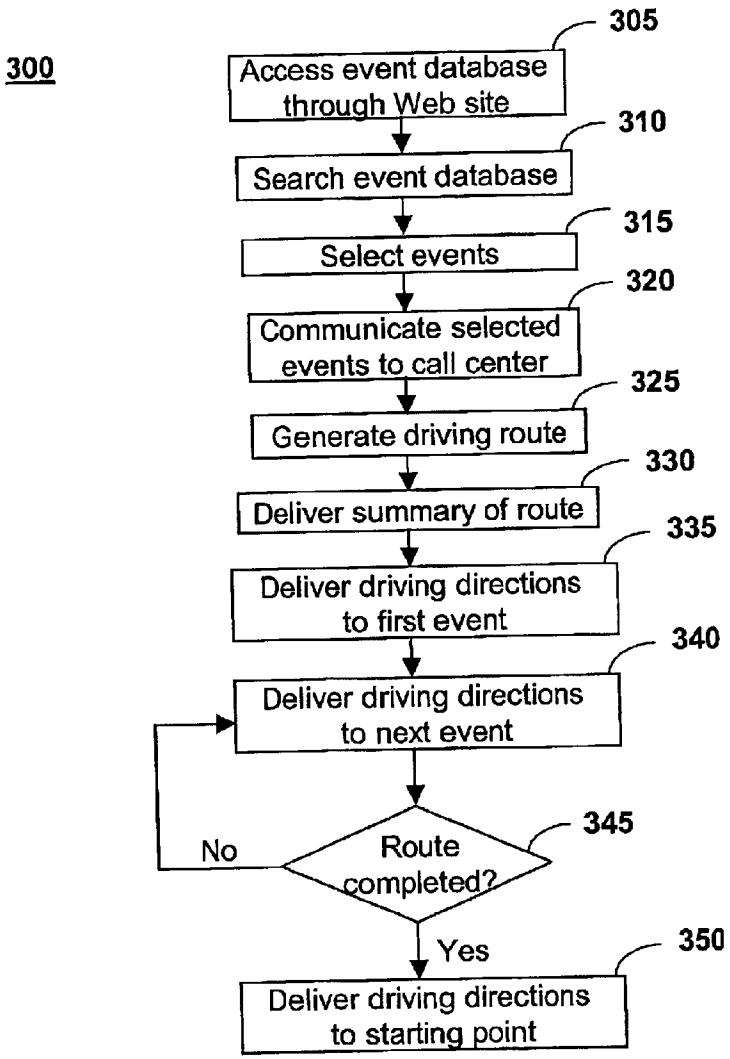
FIG. 3 is a flow diagram of another embodiment of a method for delivering a time-efficient mobile vehicle route that encompasses multiple limited-duration events in an example system according to FIG. 1.

FIG. 3 shows a flow diagram of a second embodiment of a method for delivering a time-efficient mobile vehicle route that encompasses multiple limited-duration events, in accordance with the current invention at 300. Mobile vehicle route delivery method 300 comprises steps to access a database of limited-duration events, select desired events from the database, and receive a driving route that enables a subscriber to attend the selected events at appropriate times while driving the shortest distance.

A subscriber may access a database of limited-duration events by signing on to Web site 160 (Block 305). The subscriber may search the database for desired events using an appropriate search engine (Block 310). The subscriber may select events from the database (Block 315). The selected events may be communicated from Web site 160 to call center 150 (Block 320).

Call center 150 may generate a driving route based on an algorithm that takes into consideration the times and locations of the events and thereby enables the subscriber to attend the selected events at appropriate times while driving the shortest distance (Block 325). The driving route may start from the current location of the vehicle as determined by a global positioning system within the vehicle.

A route summary may be delivered by the synthesized voice interface (Block 330). An example of a route summary may be as follows: "Your first stop is [the address or name of the first event]. Your second stop is [the address or name of the second event]. Your third stop is [the address or name of the third event]." Each event address or name may be listed in sequence until all of the events are identified.

Once the events have been summarized, the subscriber may receive detailed driving directions to the first event (Block 335). After attending that event and returning to the vehicle, the subscriber may receive detailed driving directions to the next event by issuing a voice command such as "resume route" (Block 340). After all of the events have been completed (Block 345), the subscriber may, if desired, receive driving directions back to the vehicle starting point (Block 350).

Figure 4:
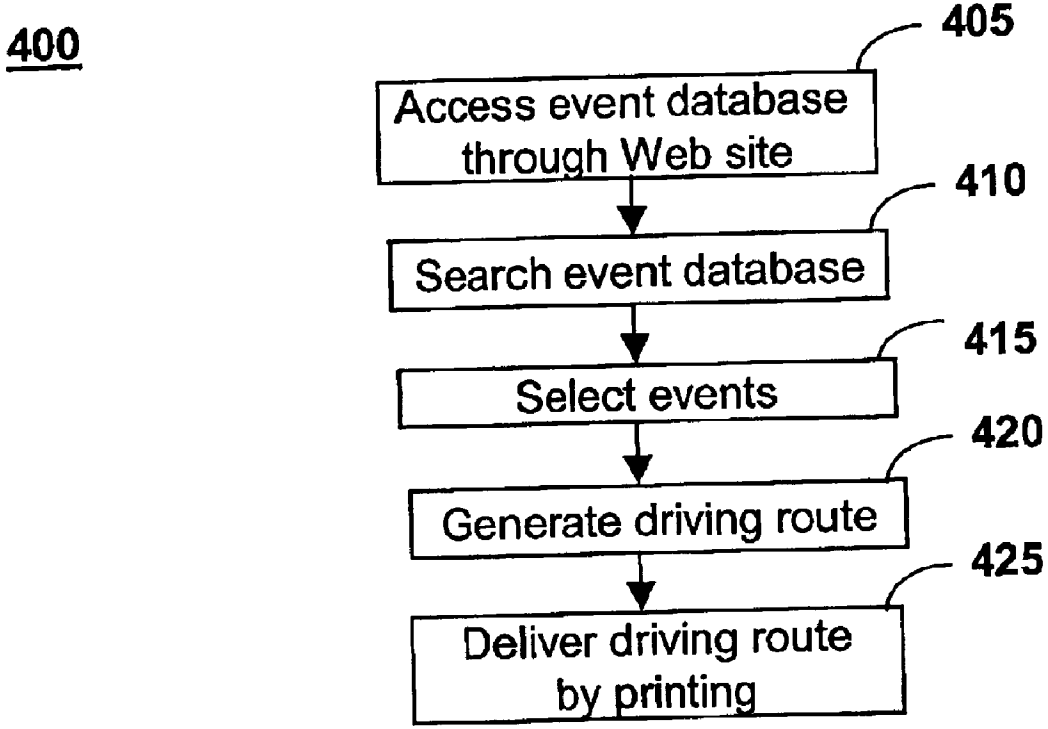
FIG. 4 is a flow diagram of another embodiment of a method for delivering a time-efficient mobile vehicle route that encompasses multiple limited-duration events in an example system according to FIG. 1.

FIG. 4 shows a flow diagram of a third embodiment of a method for delivering a time-efficient mobile vehicle route that encompasses multiple limited-duration events, in accordance with the current invention at 400. Mobile vehicle route delivery method 400 comprises steps to access a database of limited-duration events, select desired events from the database, and receive a driving route that enables a subscriber to attend the selected events at appropriate times while driving the shortest distance.

A subscriber may access a database of limited-duration events by signing on to Web site 160 (Block 405). The subscriber may search the database for desired events using an appropriate search engine (Block 410). The subscriber may select events from the database (Block 415).

Web site 160 may generate a driving route based on an algorithm that takes into consideration the times and locations of the events and thereby enables the subscriber to attend the selected events at appropriate times while driving the shortest distance (Block 420). The driving route may be delivered by printing from Web site 160 (Block 425).

In practice, the route information obtained through the described method may save a subscriber time in reaching the locations of multiple limited-duration events. The method may assist the subscriber in finding events for which limited published information is available. The method may also provide information on events at a time when the subscriber is in a mobile vehicle and does not have access to information regarding the events through other sources. In addition, the method may increase public awareness of events, resulting in visibility and added revenues for the sponsors of the events.

While the embodiments of the invention disclosed herein are presently considered to be preferred, various changes and modifications can be made without departing from the spirit and scope of the invention. The scope of the invention is indicated in the appended claims, and all changes and modifications that come within the meaning and range of equivalents are intended to be embraced therein.

What is claimed is:

1. A method for delivering a time-efficient mobile vehicle route that encompasses multiple limited-duration events, comprising:

selecting a plurality of limited-duration events from an events database;

generating a driving route based on the selected limited-duration events; and delivering the route to a subscriber.

2. The method of claim 1 further comprising:

incorporating the events database into a communication services database associated with a call center.

3. The method of claim 1 wherein:

selecting a plurality of limited-duration events from an events database comprises selecting the events within a mobile vehicle using a synthesized voice interface.

4. The method of claim 3 wherein events available for selection are located within a limited geographic area relative to the mobile vehicle.

5. The method of claim 4 wherein the size of the limited geographic area is predetermined by a call center.

6. The method of claim 4 wherein the size of the limited geographic area is specified by the subscriber on a Web site.

7. The method of claim 1 wherein:

generating a driving route based on the selected limited-duration events comprises generating the driving route at a call center.

8. The method of claim 1 wherein:

delivering the route to a subscriber comprises delivering the driving route within a mobile vehicle using a synthesized voice interface.

9. The method of claim 1 wherein:

delivering the route to the subscriber comprises sending a portion of the route generated corresponding to at least one of the plurality of limited-duration events upon user request.

10. The method of claim 1 wherein:

selecting a plurality of limited-duration events from an events database comprises selecting events on a Web site.

11. The method of claim 1 wherein:

generating a driving route based on the selected limited-duration events comprises generating the route by a Web site.

12. The method of claim 10 further comprising:

communicating the selected events to a call center.

13. A computer usable medium including a program for delivering a time-efficient mobile vehicle route that encompasses multiple limited-duration events, comprising:

computer program code for selecting a plurality of limited-duration events from an events database;

computer program code for generating a driving route based on the selected limited-duration events; and computer program code for delivering the route to a subscriber.

14. The computer usable medium of claim 13 further comprising:

computer program code for incorporating the events database into a communication services database associated with a call center.

15. The computer usable medium of claim 13 wherein:

selecting a plurality of limited-duration events from an events database comprises selecting the events within a mobile vehicle using a synthesized voice interface.

16. The computer usable medium of claim 13 wherein:

generating a driving route based on the selected limited-duration events comprises generating the driving route at a call center.

17. The computer usable medium of claim 13 wherein:

delivering the route to a subscriber comprises delivering the driving route within a mobile vehicle using a synthesized voice interface.

18. The computer usable medium of claim 13 wherein:

delivering the route to a subscriber comprises sending a portion of the route generated corresponding to at least one of the plurality of limited-duration events upon user request.

19. A system for delivering a time-efficient mobile vehicle route that encompasses multiple limited-duration events, comprising:

means for selecting a plurality of limited-duration events from an events database;

means for generating a driving route based on the selected limited-duration events;

means for delivering the route to a subscriber.

20. The system of claim 19 further comprising:

means for incorporating the events database into a communication services database associated with a call center.

* * * * *